US007037141B1

(12) United States Patent
Huang

(10) Patent No.: US 7,037,141 B1
(45) Date of Patent: May 2, 2006

(54) COMMUNICATION SOCKET HAVING A CHANNEL TRANSVERSELY DEFINED IN THE BODY AND A PLUG IDENTIFYING MEMBER SECURELY RECEIVED IN THE CHANNEL

(76) Inventor: Huang-Chou Huang, No. 377, Fu-Teh First Rd., Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/053,360

(22) Filed: Feb. 8, 2005

(51) Int. Cl.
*H01R 24/00* (2006.01)

(52) U.S. Cl. ..... 439/676; 439/677

(58) Field of Classification Search ..... 439/676, 439/677

See application file for complete search history.

(56) References Cited

U.S. PATENT DOCUMENTS 5,679,013 A * 10/1997 Matsunaga et al. ..... 439/144
6,273,761 B1 * 8/2001 Hsu et al. ..... 439/676
6,283,796 B1 * 9/2001 Yeh ..... 439/677
6,296,528 B1 * 10/2001 Roberts et al. ..... 439/676
6,312,293 B1 * 11/2001 Wang ..... 439/677
6,319,070 B1 * 11/2001 Tan ..... 439/680
6,808,427 B1 * 10/2004 Xue ..... 439/676
6,918,794 B1 * 7/2005 Wan et al. ..... 439/676
6,957,984 B1 * 10/2005 Huang ..... 439/676

* cited by examiner

*Primary Examiner*—Hae Moon Hyeon
(74) *Attorney, Agent, or Firm*—Dellett & Walters

(57) ABSTRACT

A communication socket includes a body having a channel transversally defined in the body. A plug identifying member with a U shape has a shaft, and two sliding bars formed at two opposed ends of the shaft and perpendicular to the shaft. Each sliding bar has a free end with a triangular longitudinal section. Two pivot pins are respectively provided on the sliding bars and adjacent to the shaft and rotatably received in the channel. Two blocks with a shorter length than that of the sliding bars are respectively formed on interior sides of the sliding bars. Two elastic strips are respectively formed under the sliding bars and extend from the shaft. Whereby, when a plug is inserted in the socket, the elastic strips are pressed downward, and the plug identifying member will return to the original position under the force of the elastic strips.

1 Claim, 8 Drawing Sheets

COMMUNICATION SOCKET HAVING A CHANNEL TRANSVERSELY DEFINED IN THE BODY AND A PLUG IDENTIFYING MEMBER SECURELY RECEIVED IN THE CHANNEL

BACKGROUND OF THE INVENTION

1. Field of the Invention

The present invention relates to a communication socket, and more particularly to a communication socket which prevents an unmatched plug to be inserted therein.

2. Description of Related Art

Conventional communication sockets for transferring signals have a body covered with a shell. The communication sockets have various types to correspond to various plugs such as RJ12 and RJ45, wherein the RJ45 plug is slightly wider than the RJ12 plug. If the RJ12 plug with a small width is inserted into the RJ45 socket, the conventional socket may be damaged and will no longer be able to be properly connected to the matched RJ45 plug.

Another conventional communication socket was invented to eliminate the above shortcoming. With reference to FIG. 10, this conventional communication socket has a body (50) which has a channel (51) with a semicircular cross section and therefore a plug identifying structure (60) can be received in the channel (51). The plug identifying structure (60) with a U-like shape viewed at the top side, has an axle (61) engaged with the channel (51) and is rotatable relative to the channel (51). Two sliding bars (62) are respectively provided on two opposed ends of the axle (61) and each of the sliding bars (62) has a triangular free end (not numbered). Two blocks (63) are respectively formed on the sliding bars (62) and a distance between them is smaller than a distance between the two sliding bars (62). When a matched plug is inserted into the communication socket, the sliding bars (62) will be pressed downwards to allow the matched plug to access the socket. If a narrow plug is inserted into the socket, the sliding bars (62) cannot be pushed downwards by the plug just located between the two sliding bars (62), so the plug will be obstructed by the blocks (63) and cannot be inserted into the socket.

However, the plug identifying member (60) cannot return to the original status automatically after the matched plug is removed from the socket. Thus, it is very inconvenient for a user to have to manually reset the plug identifying member (60) after removing the plug or before inserting the plug the next time.

Therefore, the invention provides a communication socket with a plug identify structure to mitigate or obviate the aforementioned problems.

SUMMARY OF THE INVENTION

The main objective of the present invention is to provide a communication socket of which a plug identifying member can be reset automatically.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
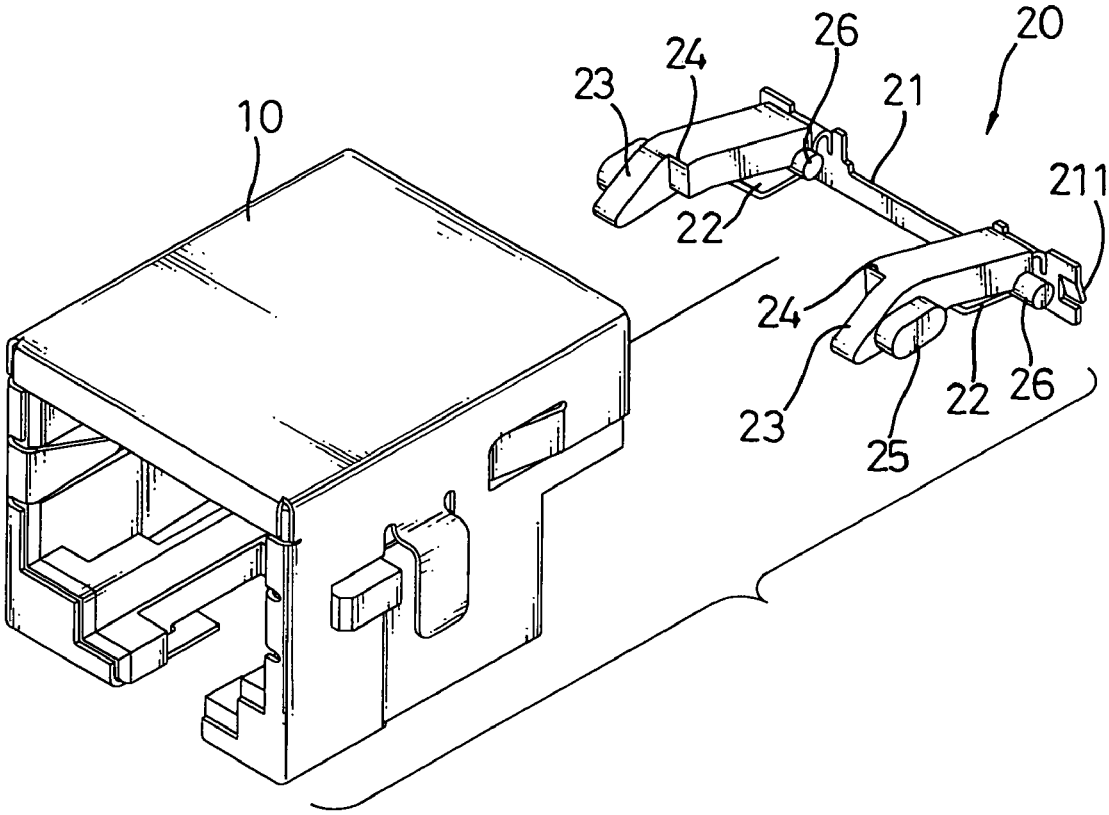
FIG. 1 is an exploded perspective view of a communication socket with a plug identifying member in accordance with the present invention.
Figure 2:
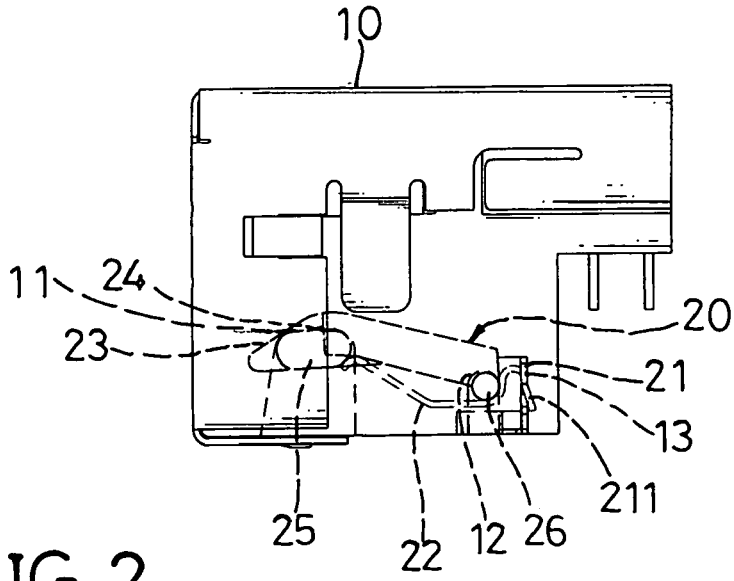
FIG. 2 is a side view of the communication socket in accordance with the present invention.
Figure 3:
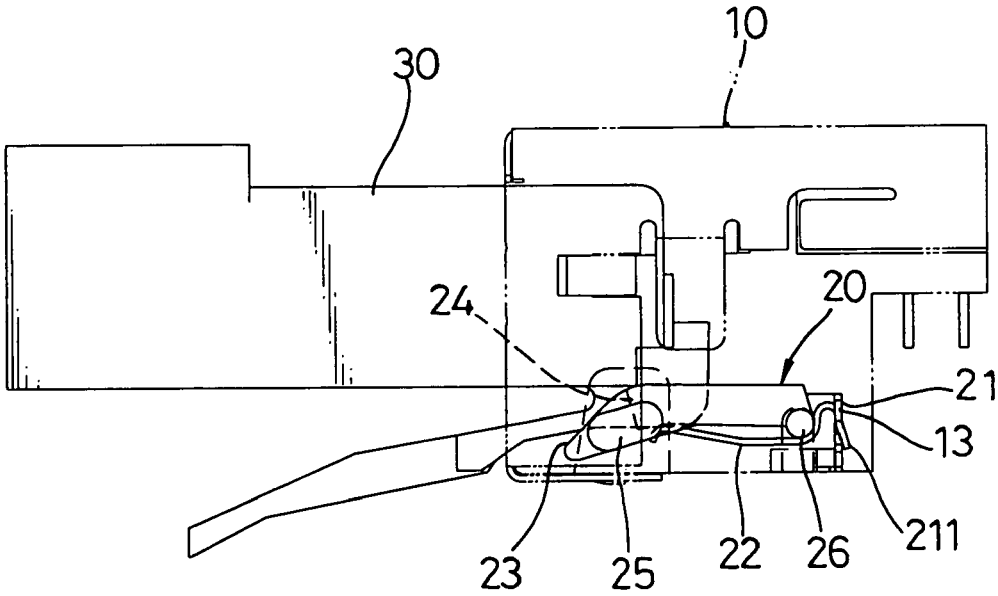
FIG. 3 is a side view showing a matched plug (RJ45) being inserted in the communication socket.
Figure 4:
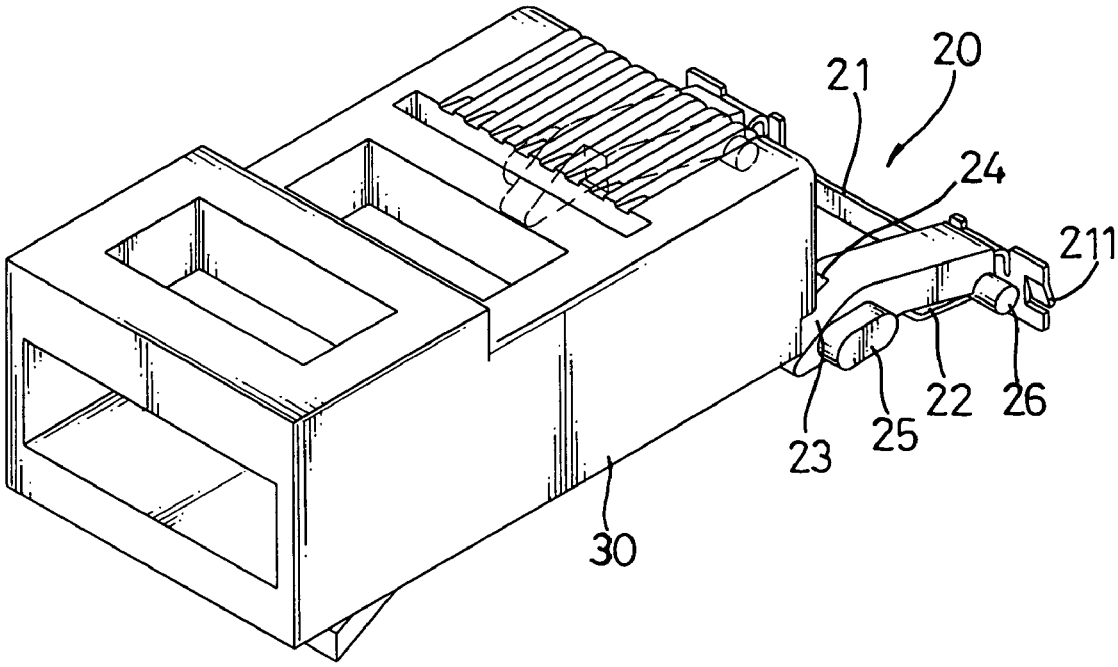
FIG. 4 is a perspective view of the plug identifying member being mated with the plug (RJ45)
Figure 5:
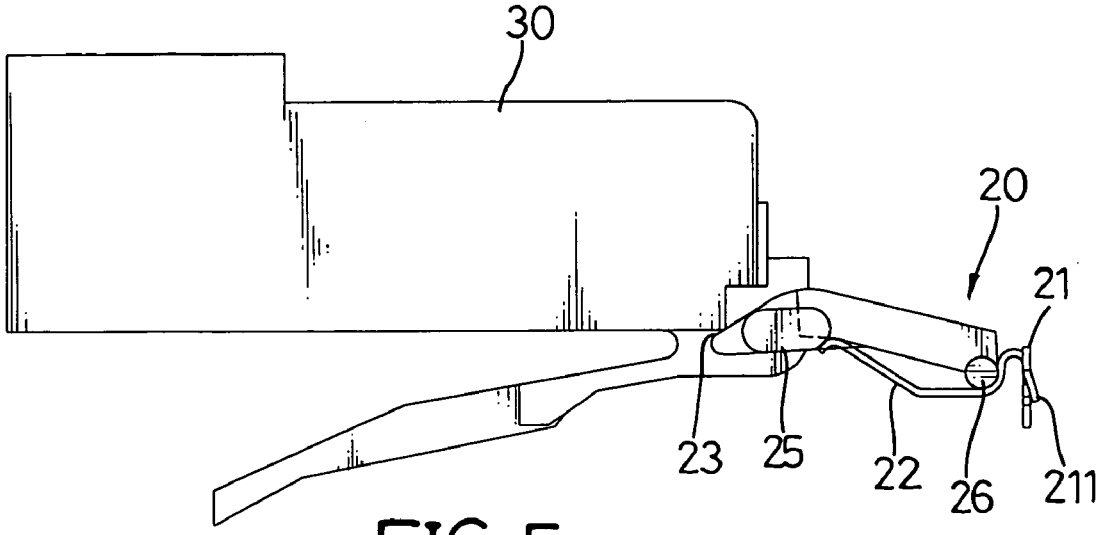
FIG. 5 is a side view showing the plug identifying member before being pressed by the plug (RJ45)
Figure 6:
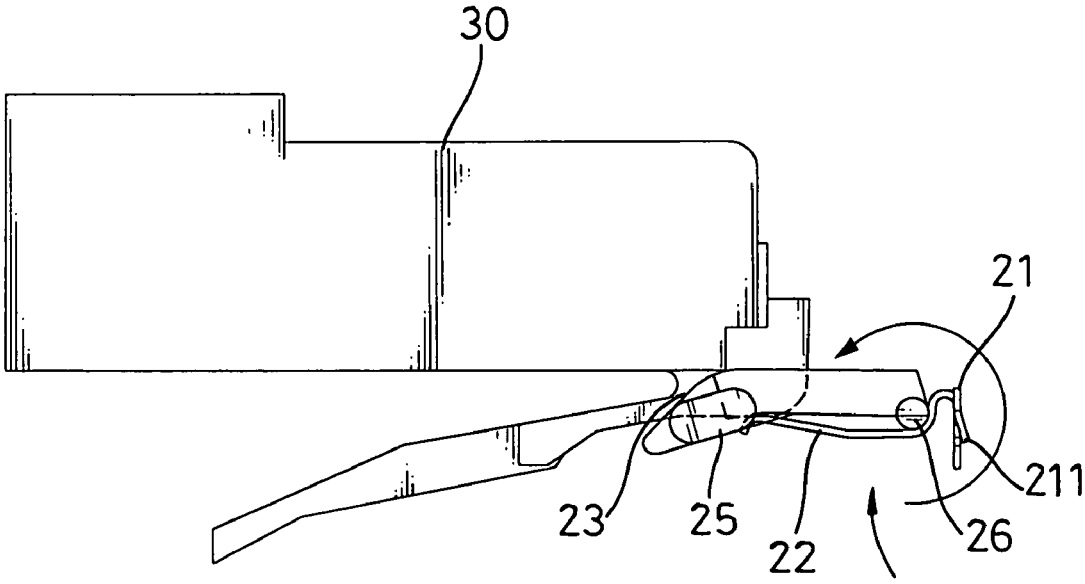
FIG. 6 is a side view of the plug identifying member being pressed by the plug (RJ45)

With reference to FIGS. 1–2, a communication socket in accordance with the present invention has a body (10) with a channel (12) transversally defined in the body (10). A plug identifying member (20) is received in the channel (12). The plug identifying member (20) with a U-like shape has a shaft (21) and two sliding bars (23) respectively formed on two opposed ends of the shaft (21) and perpendicular to the shaft (21). Each sliding bar (23) has a free end with a triangular longitudinal section. Two pivot pins (26) are respectively provided on the sliding bars (23) and are adjacent to the shaft (21). The pivot pins (26) are received in the channel (12) to rotatably mount the plug identifying member (20) in the body (10).

Two blocks (24) with a shorter length than that of the sliding bars (23) are respectively formed on interior sides of the sliding bars (23). Two elastic strips (22) are respectively formed beneath the sliding bars (23) and extend from the shaft (21). Two lugs (25) are respectively formed on exterior sides of the sliding bars (23) and are respectively received in two grooves (11) defined in two inner walls of the body (10) so as to position the plug identifying member (20) in the body (10).

Two fasteners (211) are respectively formed at the opposed ends of the shaft (21) and attached to two notches (13) in the two sides of the body (10) to further secure the plug identifying member (20) in the body (10).

With reference to FIGS. 3–6, when a matched plug (30) such as an RJ45 plug is inserted into the body (10), the sliding bars (23) are pressed downwards and rotated downwards about the pivot pins (26) to allow the plug (30) to access the body. At the same time, the elastic strips (22) are also compressed downwards by the sliding bars (23). When the RJ45 plug (30) is removed from the socket, the sliding bars (23) can be pushed upwards due to the resilient forces of the elastic strips (22) and return to the original position.

Figure 7:
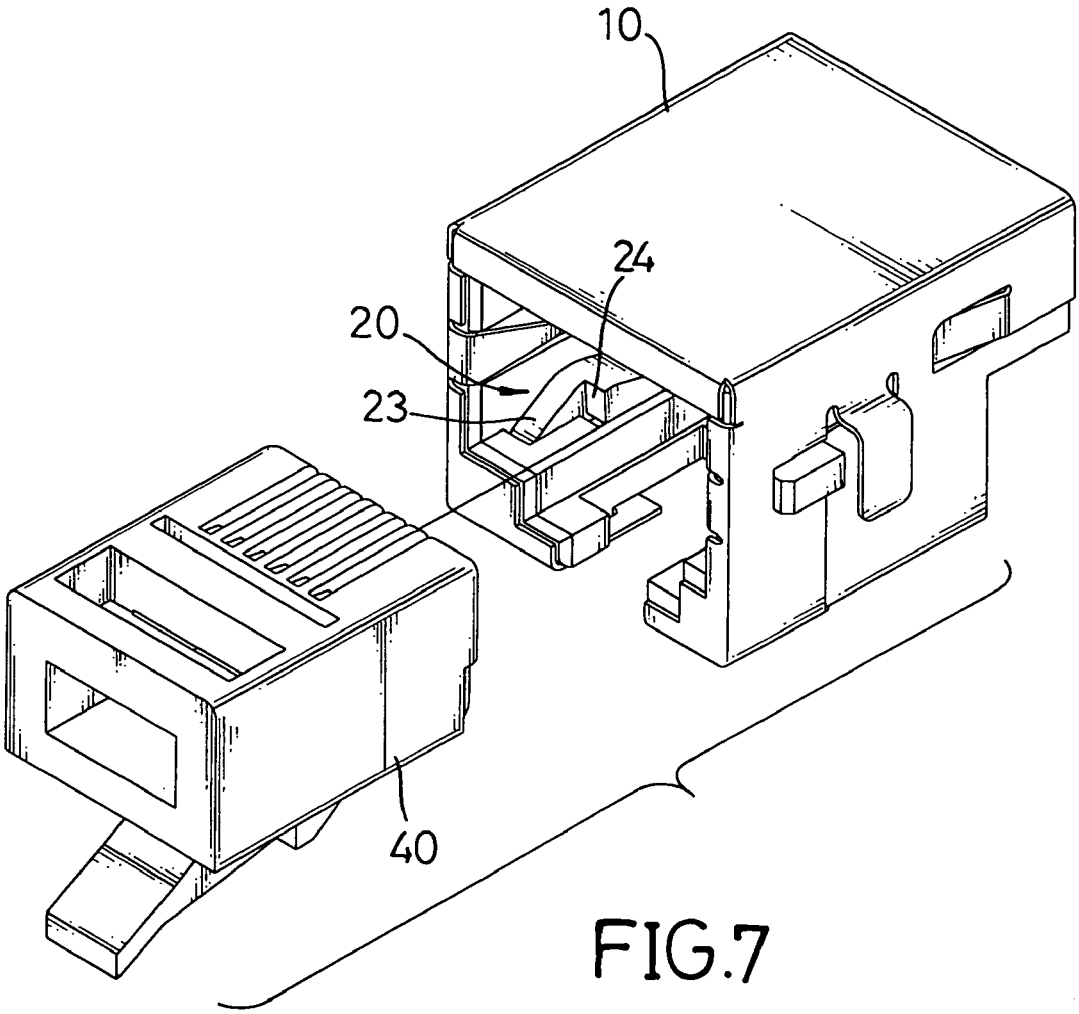
FIG. 7 is a perspective view of an unmatched plug (RJ12) being inserted into the socket.
Figure 8:
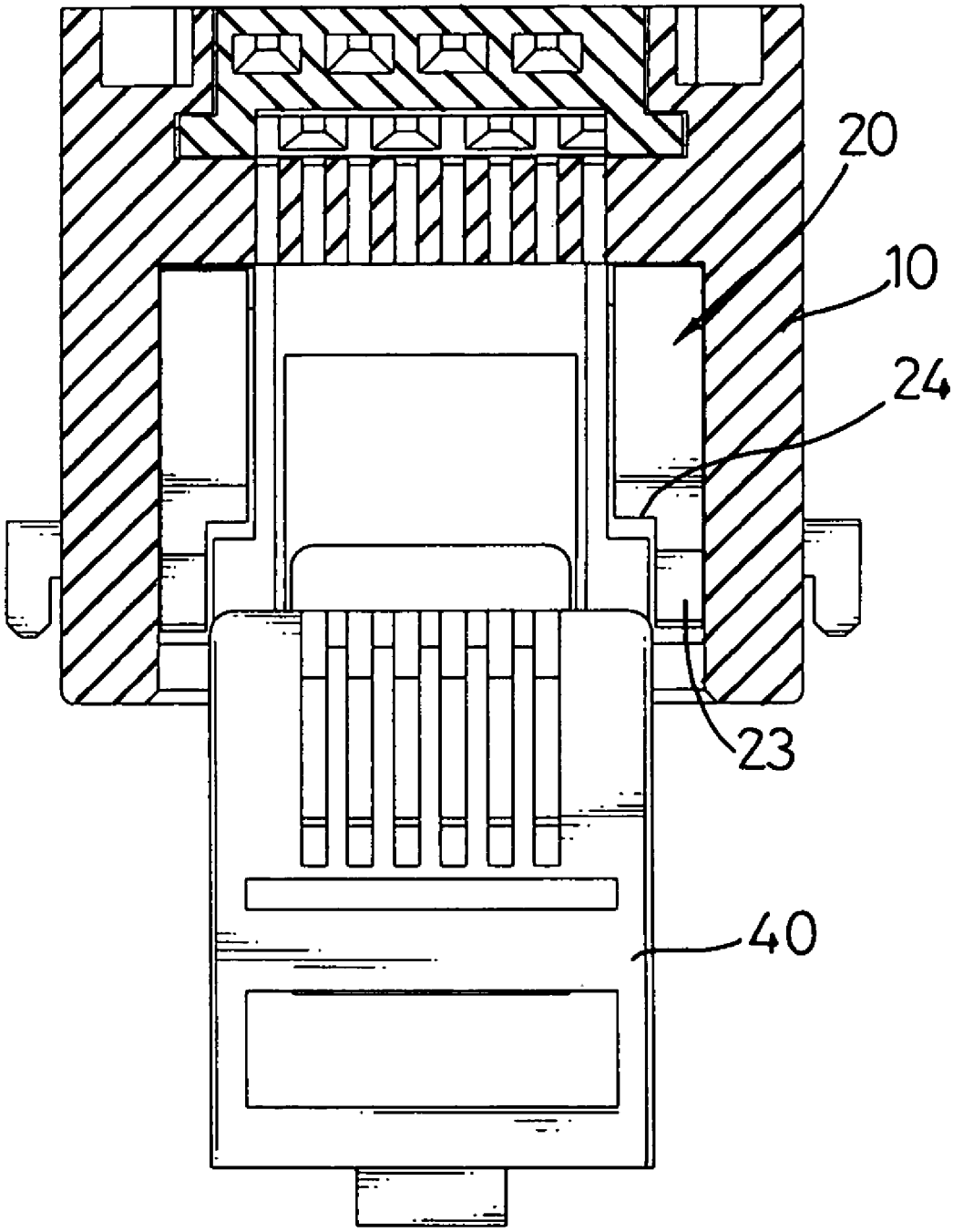
FIG. 8 is a top sectional view of the unmatched plug (RJ12) being inserted into the socket.
Figure 9:
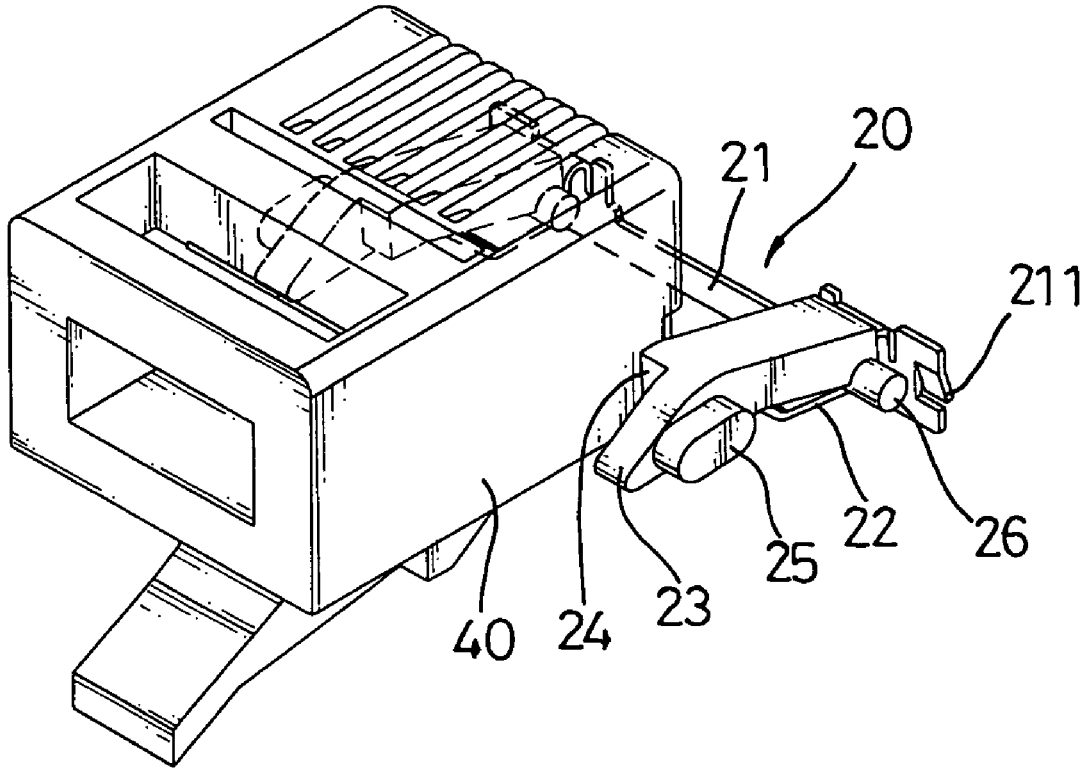
FIG. 9 is a perspective view of the unmatched plug (RJ12) being obstructed by the plug identifying member.
Figure 10:
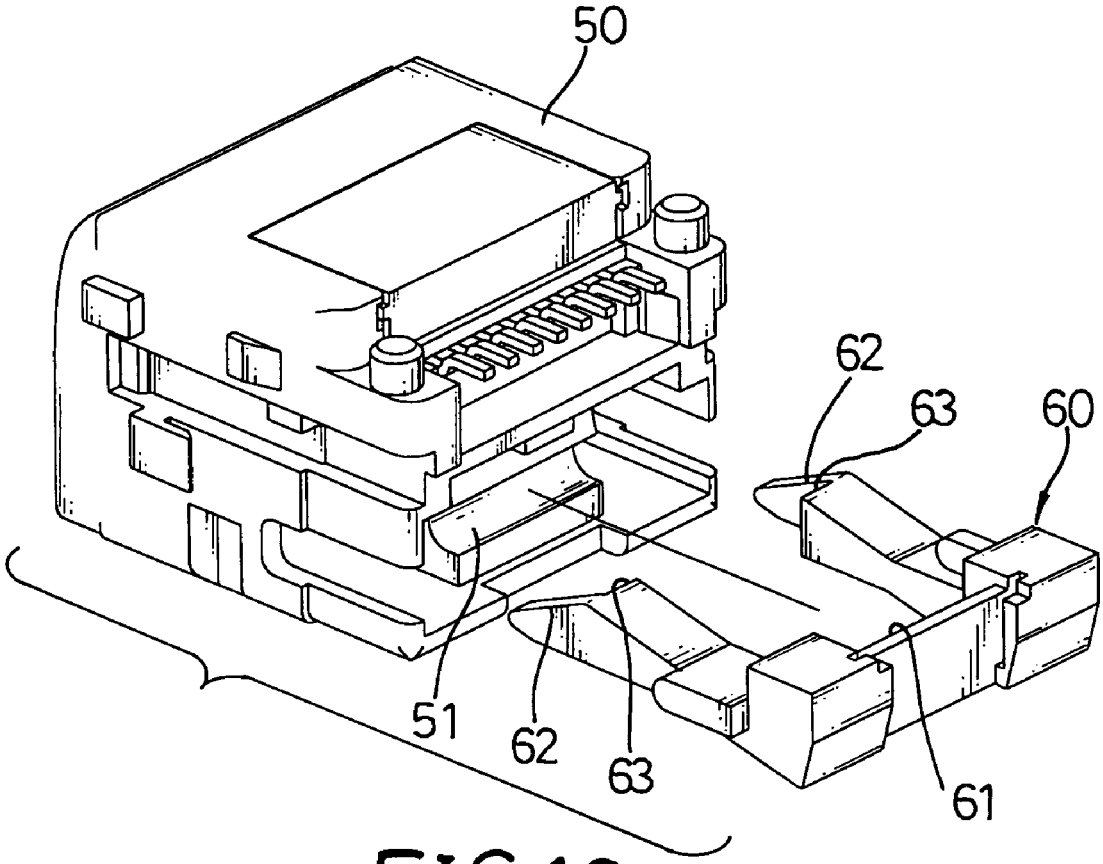
FIG.10 PRIOR ART
FIG. 10 is an exploded perspective view of a conventional communication socket with a plug identifying member.

With reference to FIGS. 7–9, when an unmatched plug (40) such as an RJ12 with a small width is inserted into the body (10), the plug (40) will be obstructed by the blocks (24) and cannot be inserted further into the socket. Thus, the plug identifying member (20) prevents the unmatched plug from mistakenly being inserted, thereby protecting the socket as well as the plug (40).

Furthermore, even if the RJ12 plug (40) is inserted in the socket against a side of the body (10), as shown in FIG. 9, one of the blocks (24) which is adjacent to the RJ12 plug (40) still obstructs the plug (40) and can protect the socket.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A communication socket comprising a body having a channel transversely defined in the body and a plug identifying member securely received in the channel and provided with a shaft, two sliding bars respectively and perpendicularly formed at two opposed ends of the shaft, each sliding bar having a free end with a triangular longitudinal section, two pivot pins respectively provided on the sliding bars and adjacent to the shaft and rotatably received in the channel, two blocks each fanned on a side of a corresponding one of the sliding bars and provided with a length shorter than a length of the corresponding one of the sliding bars, wherein the improvements comprise:

two elastic strips are adapted to be respectively formed under the two sliding bars and extend from the shaft to provide a recoil force to the two sliding bars such that after the two sliding bars are pressed downward inside the body, the recoil force from the two elastic strips returns the two sliding bars to their original position, two grooves are adapted to be defined respectively in two inner walls of the body to accommodate two lugs respectively formed on exterior sides of the sliding bars, and two notches are adapted to be defined in the body to receive therein two fasteners respectively formed at two opposed ends of the shaft.

* * * * *